United States Patent [19]

Jeschke

[11] Patent Number: 4,613,125

[45] Date of Patent: Sep. 23, 1986

[54] METHOD AND DEVICE FOR FEEDING SHEETS IN REGISTER IN A SHEET-PROCESSING MACHINE

[75] Inventor: Willi Jeschke, Heidelberg, Fed. Rep. of Germany

[73] Assignee: Heidelberger Druckmaschinen AG, Heidelberg, Fed. Rep. of Germany

[21] Appl. No.: 572,654

[22] Filed: Jan. 20, 1984

[30] Foreign Application Priority Data

Jan. 20, 1983 [DE] Fed. Rep. of Germany ..... 3301722

[51] Int. Cl.[4] ..... B65H 7/02

[52] U.S. Cl. ..... 271/227; 271/237; 271/250; 271/245

[58] Field of Search ..... 271/227, 228, 236, 237, 271/250, 252, 245

[56] References Cited

U.S. PATENT DOCUMENTS 3,741,357 6/1973 Krysiuk ..... 271/227
3,743,277 7/1973 Hans-Bernard ..... 271/237 X
3,979,115 9/1976 Bruckner ..... 271/227 X
4,052,054 10/1977 Cardwell ..... 271/227
4,455,018 6/1984 Colglazier ..... 271/227

*Primary Examiner*—Richard A. Schacher
*Attorney, Agent, or Firm*—Herbert L. Lerner; Laurence A. Greenberg

[57] ABSTRACT

A method of feeding sheets in register in a sheet-processing machine wherein the sheets are conveyed in a given direction in the machine, which includes, during conveyance of the sheets, initially displacing the sheets, respectively, by means of an aligning device, in a direction substantially perpendicularly to an edge thereof which is to be aligned, so that the edge of the sheet passes a measuring zone of a scanning device and clears the scanning device; generating a signal in response to clearance of the scanning device by the sheet edge and, in response to the generated signal, further displacing the sheet a given distance from the measuring zone of the scanning device to a position wherein the respective sheets are in register.

7 Claims, 6 Drawing Figures

METHOD AND DEVICE FOR FEEDING SHEETS IN REGISTER IN A SHEET-PROCESSING MACHINE

The invention relates to a method of in-register feeding of sheets in sheet-processing machines such as for printing wherein the sheets are aligned by means of a scanning device, and wherein each sheet is moved by an aligning device substantially perpendicularly to the sheet edge which is to be aligned.

Precise aligning of the sheets by the leading edge and/or by a side edge thereof at very high machine speeds is possible only with great difficulty in conventional machines of this general type because the sheets are guided against mechanical stops, for example, front and side lays. The sheets are aligned by pushing or pulling. At extreme speeds of printing presses, this results in a high degree of out-of-register printed products.

German Patent No. 23 22 194 discloses a method wherein, before a sheet is laid or fed-in, the position of the sheet is detected by means of a scanning device and, for aligning the sheet, adjustable front lays are provided on the feed table. The scanning device is forced of at least one transmitter and one receiver, and is disposed between the grippers of the impression cylinder in order to scan the leading edge of the sheet. By suitable application of switching means, the adjustable front lays are then set into position for aligning the sheet.

A disadvantage of such a device is the costly construction of the adjustable front lays for aligning the sheet. Above all, however, devices having great mass cannot be used with precise control for performing rapid movements.

German Published Non-Prosecuted Application (DE-OS) No. 30 33 780 describes a method of controlling the arrival of sheets at the inlet of printing presses. The respective arrival of the sheet is monitored within set time intervals. Furthermore, a signal generator is provided which triggers a readjustment of the sheet feed. Thus, it is known to monitor by electro-optical scanning means the arrival of the individual sheets at the feed-in location to establish whether the arrival is at set intervals i.e. within a predetermined range of angular rotation of a printing press roller. An automatic shutdown of the press occurs if the arrival of the sheet is outside the tolerance range.

The time available for aligning a sheet is also dependent upon the overlap of the sheets within the continuous stream. The lateral alignment of a sheet must always occur quickly and promptly so that the next sheet in the stream can undergo exactly the same process. The lateral pulling operation can take place only when the trailing edge of the sheet has left the operating range of the side lay. By minimizing the individual distances between the sheets in the stream it is possible to reduce the speed of the sheet on the feed table within limits which, for like or equally good aligning, permits theoretically higher press speeds.

British Patent No. 1 323 868 describes a method of checking or controlling in-register printed sheets. This control or checking operation is performed in advance of or within each printing unit, taking into account the respective reference lines. Position deviation on the sheets is measured and, thereafter, digital correction pulses are transmitted to the actuators in accordance with the position differences. A disadvantage is that each position deviation of the sheets from the setpoint or desired position necessitates a measurement and a corresponding adjustment of the sheet conveying means which likewise have relatively great mass.

It is an object of the invention to provide a method and device for in-register feeding of sheets in sheet-processing machines which avoids the deficiencies of the heretofore known methods and devices of this general type and, primarily, to reduce the masses therein which have to be moved for aligning. Furthermore, an aligning method is sought after which preserves the edges of the sheets and which does not require any stops or side lays.

With the foregoing and other objects in view, there is provided, in accordance with the invention, a method of feeding sheets in register in a sheet-processing machine wherein the sheets are conveyed in a given direction in the machine, which comprises, during conveyance of the sheets, initially displacing the sheets, respectively, by means of an aligning device, in a direction substantially perpendicularly to an edge thereof which is to be aligned, so that the edge of the sheet passes a measuring zone of a scanning device and clears the scanning device; generating a signal in response to clearance of the scanning device by the sheet edge and, in response to the generated signal, further displacing the sheet a given distance from the measuring zone of the scanning device to a position wherein the respective sheets are in register.

Because the aligning, according to the invention, occurs during movement of the sheet i.e. no fixed stops are required, it is possible to increase the sheet conveying speed considerably. There is no need for any time-consuming and costly determination of the position of the nonaligned sheet and, thus, unecessary to calculate an individual correction distance for each sheet. The method according to the invention is thereby particularly suitable for the flow-feeding of sheets. The clearing of the scanning device ensures, in a relatively simple manner, that the method according to the invention may be applied to continuous-stream feeders because the scanning device is again ready for the next aligning operation before the previously aligned sheet has to be pulled off.

Consequently, in accordance with a particularly advantageous mode, the method according to the invention, wherein the sheets are conveyed in a continuous stream feeding operation wherein respective leading edge portions of succeeding sheets overlap respective trailing edge portions of preceding sheets, includes displacing the sheets transversely to the conveying direction and passing a side edge of the respective sheets of the stream of sheets past the measuring zone of the scanning device and, after the passage of the side edge has been detected by the scanning device, moving the sheets transversely to the sheet-conveying direction a given constant distance for all of the sheets into the in-register position.

Because of the flowing aligning operation and the clearing of the scanning device by the aligning displacement, it is possible to keep the distance between the sheets in the continuous stream very small, which contributes towards increasing the feed rate.

In accordance with a further mode, the method according to the invention includes covering the scanning device with a leading edge portion of the respective sheets and simultaneously checking respective leading edges of the sheets by means of the scanning device. In this way, it is possible to obtain both leading edge as well as side edge alignment in a relatively simple manner.

In accordance with an additional mode of the method according to the invention, the initial aligning displacement of the sheets includes first covering the scanning device with the respective sheets, but then clearing it again. In this connection, it is necessary for the sheet to perform a movement first towards the scanning device and then away from the scanning device, as a result of which, the edge of the sheet passes the measuring zone of the scanning device twice, the two generated signals being used for initiating the aligning movement to the in-register position. In this mode of the method according to the invention, it is not necessary to move the pile laterally. The tolerance width of the sheets in the stream transverse to the conveying direction, with as short an aligning distance as possible, can be extended, if the sheets in the stream, prior to the initiation of the aligning displacement towards the scanning device, both cover the measuring zone as well as do not cover it. Here too, it is not necessary to offset the pile of sheets laterally.

In accordance with an added mode, the method according to the invention includes averaging a plurality of signals generated in response to the clearance of the scanning device measuring zone by the respective sheet edge of each of the sheets.

In accordance with another aspect of the invention, there is provided a device for feeding sheets in register in a sheet-processing machine wherein the sheets are conveyed in a given direction in the machine, comprising a scanning device including at least one sensor for sensing passing of a sheet edge by said sensor and for generating signals in response to said passing, a triggered, digital electronic control system connected to the sensor for processing and transmitting the generated signals, and an aligning device coupled with the control system for executing displacement of the respective sheets in accordance with the signals and for displacing the respective sheets into a prescribed position.

In accordance with a further feature of the device according to the invention, means are provided for varying a distance over which the respective sheets are displaced by the aligning device so as to dispose the sheets in in-register position.

In accordance with an added feature, the device according to the invention includes a plurality of scanning devices, and means for checking both the leading edge as well as a lateral edge of the respective sheets.

In accordance with a concomitant feature, the device according to the invention includes at least one additional sensor for aligning the leading edge of the respective sheets.

Other features which are considered as characteristic for the invention are set forth in the appended claims.

Although the invention is illustrated and described herein as embodied in a method and device for feeding sheets in register in a sheet-processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
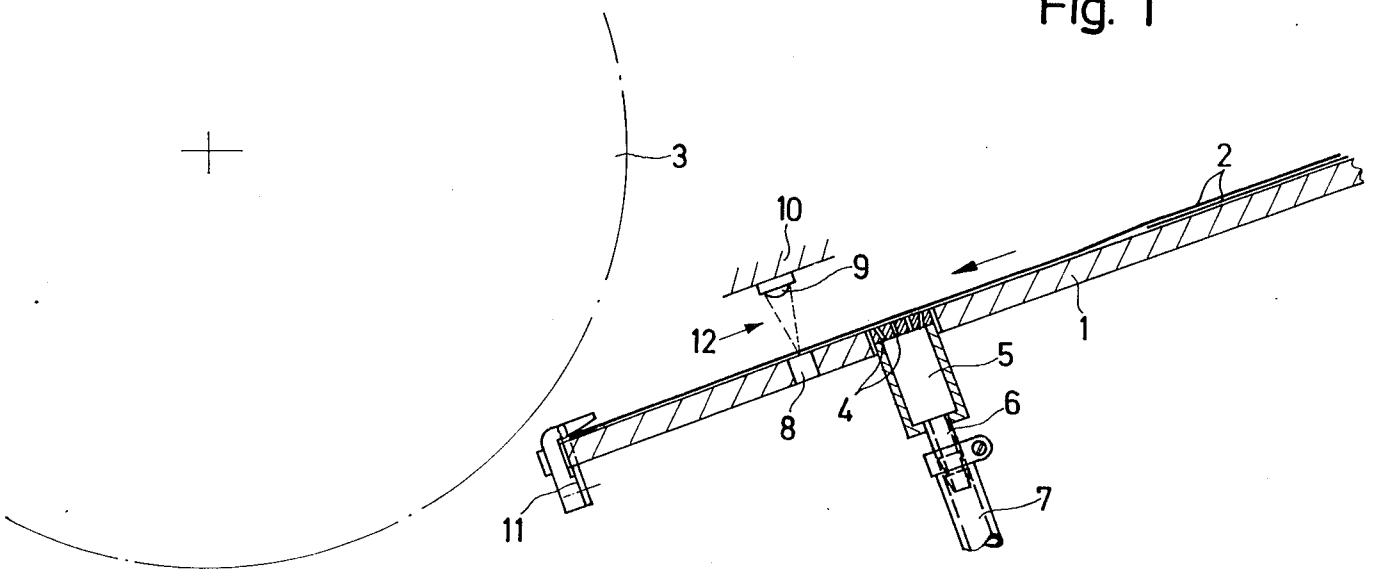
FIG. 1 is a diagrammatic view of a sheet feeder with a scanning device for implementing the method according to the invention.

Referring now to the drawing and first, particularly, to FIG. 1 thereof, there is shown diagrammatically the conveying of sheets to a first printing unit of a sheet-processing printing press not otherwise illustrated in great detail. A feed table 1 by means of which sheets 2 are conveyed to a feed cylinder 3 is disposed in an inclined attitude towards the feed cylinder 3. In the feed table 1, outlet openings 4 are provided for suction air from an aligning device which is in the form of a laterally displaceable suction box 5. The suction box 5 is coupled by means of a nozzle 6 to a hose 7 which leads to a non-illustrated suction device. This suction box 5 is succeeded in the feed table 2 by a measuring slit 8. Above the feed table 2, precisely opposite the measuring slit 8, are one or more sensors 9 with an evaluation electronic system 10, otherwise not shown in any greater detail in FIG. 1. Disposed at the end of the inclined feed table 2 are front lays 11 which can be folded away downwardly.

The uppermost sheets 2, respectively, of a non-illustrated pile of sheets run in a continuous stream over the inclined feed table 1 and are accepted by the feed cylinder 3 after they have been aligned. During the conveying of a respective sheet 2, the leading edge thereof is brought up against the front lays 11 and is aligned. Then a lateral displacement of the respective sheet by means of the suction box 5 is effected whereby the side edge of the displaced sheet is guided past a measuring line 12 formed by the sensor 9 in conjunction with the measuring slit 8.

Figure 2:
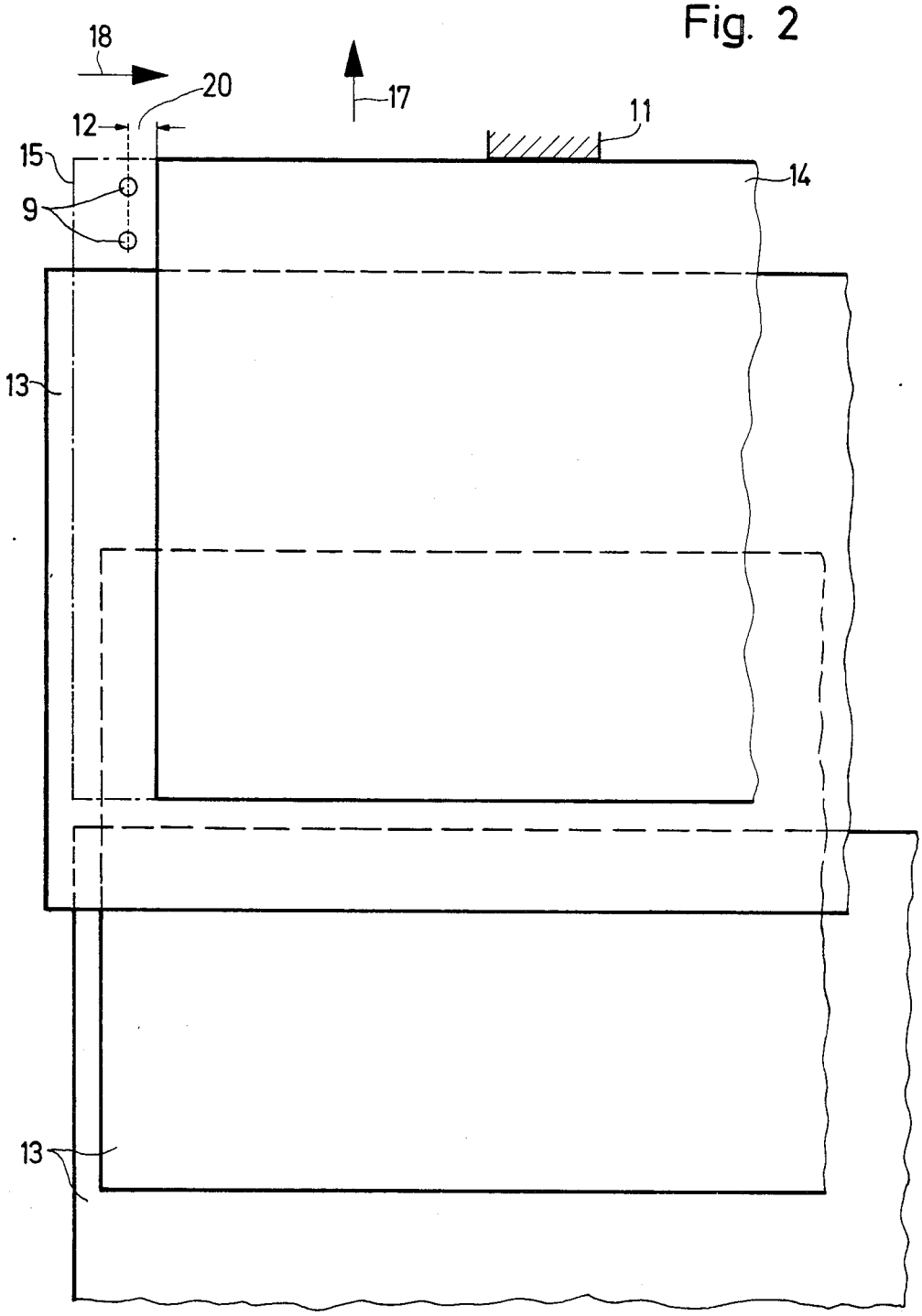
FIG. 2 is a diagrammatic top plan view of the sheet feeder showing lateral alignment of stream-fed sheets according to the invention.

FIG. 2 shows the side alignment for a continuous stream of sheets 13 wherein the sensors 9 are cleared by the aligning operation.

The stream shown in FIG. 2 is made up of a series of sheets 13 which may have a slightly different positioning from one another. All of the sheets in the stream, however, when they thrust against the front lay 11, cover the sensors 9, for example, as indicated in phantom by reference numeral 15. In this position the sheet 14 had come up against the front lay 11. The sheet 14, as shown by arrow 18, was then moved by the suction box 5 transversely to the conveying direction represented by the arrow 17. The left-hand side edge of the sheet 14 was accordingly shifted past the measuring line 12 of the two sensors 9, with the result that signals were generated causing the suction box 5 to move the sheet only by the specified distance 20. The position of the sheet 14 indicated by solid lines consequently represents the in-register aligned position thereof.

While the sheet 14 is thereafter fed by the feed cylinder 3 to the non-illustrated printing unit, the next following sheet 13 has already covered the sensors 9 again. The leading edge of the sheet 13 comes into engagement with the front lay 11. Then, the suction box 5 moves the sheet 13, which has been brought into the aligning position, in the direction of arrow 18. The left-hand side edge thereof also passes the measuring line 12 of the sensors 9, whereupon the suction box 5 transports the sheet 13 only through the set distance 20 so that this sheet 13 also reaches the in-register position which had previously been assumed by the sheet 14 in FIG. 2. Each succeeding sheet in the stream undergoes the same process. A precondition for correct side alignment is that the respective arriving sheet must cover the sensors 9. The particular position of the sheet need not be determined because, after the respective side edge of each sheet has passed the measuring line 12, each sheet is transported by the suction box 5 through the set distance 20 in the direction of the arrow 18.

Figure 3:
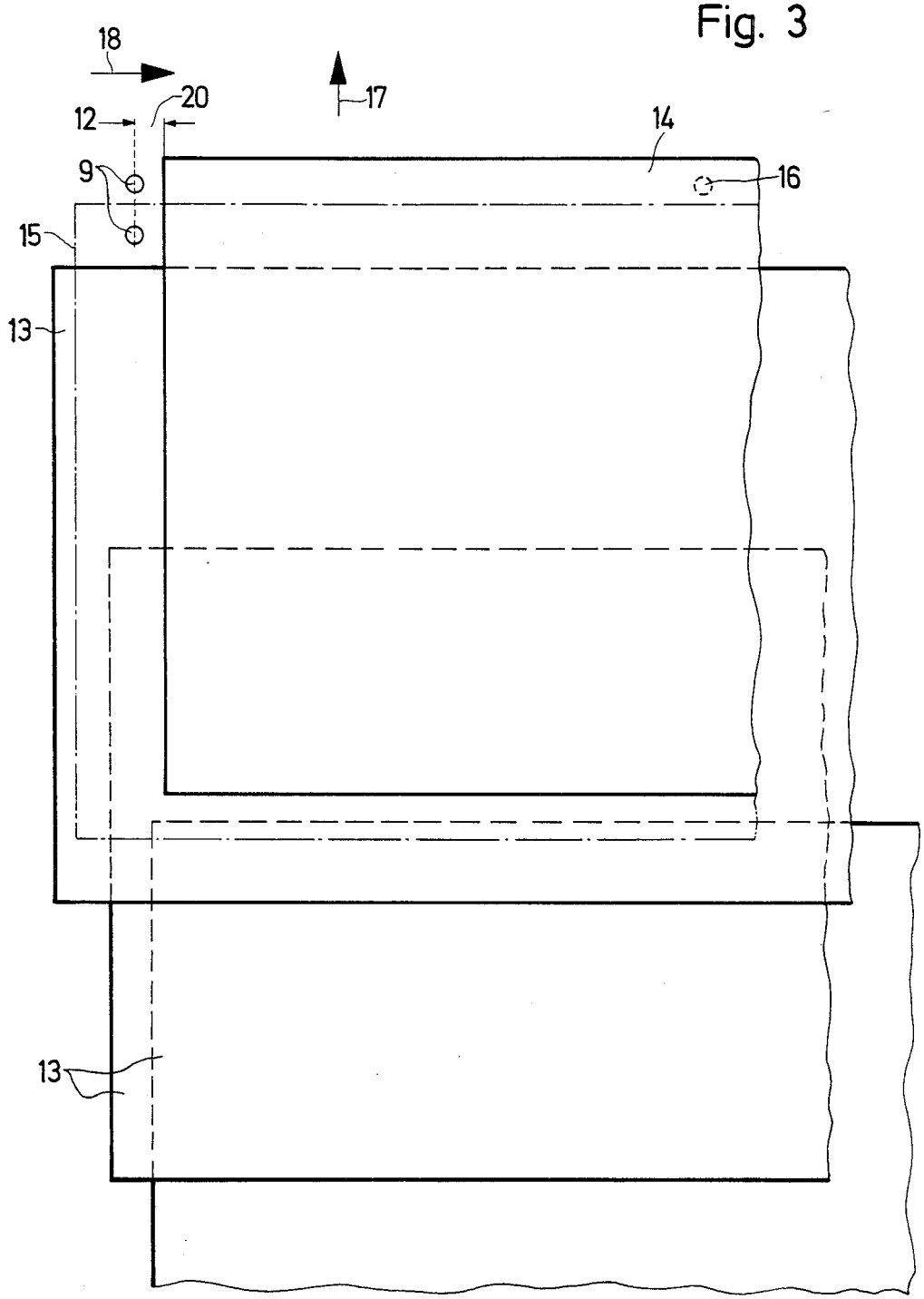
FIG. 3 is another view of FIG. 2 wherein the device according to the invention is modified by the front lays being replaced by a sensor.

In the case of a flowing sheet feed, it is possible to dispense with fixed front lays 11 and to use an additional sensor 16 for the alignment of the leaking edge of the sheets, as shown in FIG. 3. This sensor 16 is illustrated in the right-hand region at the leading edge of the sheet 14 which is to be aligned. As soon as the leading edge of the sheet has gone past both sensors 9 and the additional sensor 16, the signals from these sensors can be used in conjunction with a special control of the suction box 5 to align both the side edge as well as the leading edge of the sheet. The sheets of the continuous stream are fed in a manner so as to either cover the sensors 9 or be guided past them laterally. If the front sheet in the stream does not cover the sensors 9 in the aligning region, an aligning displacement towards the sensors 9 must be affected so as to generate the signal.

Figure 4:
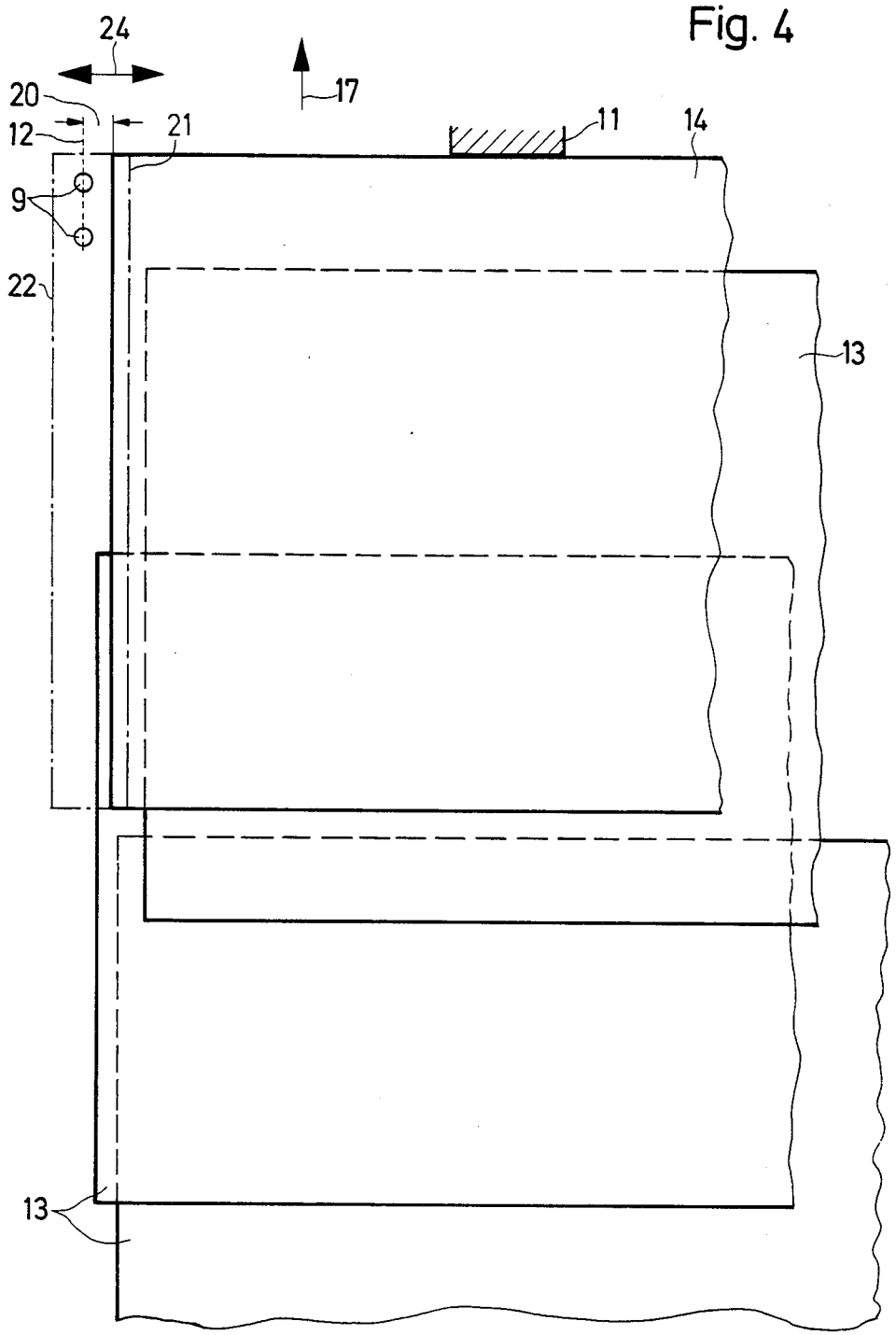
FIG. 4 is a further view of FIG. 2 wherein the device according to the invention is modified by the scanning device being covered by the sheet which is to be aligned.

The configuration of the stream of sheets 13, 14 shown in FIG. 4 differs from that shown in FIG. 2 in that all of the sheets 13, 14 in the stream, viewed in direction of the arrow 17, are guided past the sensors 9 at the right-hand side thereof. After the uppermost or leading sheet 14 in the stream comes up against the front lay 11, the edge at the left-hand side thereof has assumed the phantom position identified by the reference numeral 21. When leading or front-edge alignment has been performed, the suction box 5 moves the sheet 14, as shown by the double arrow 24, past the sensors 9 and back again into the solid-line position thereof. In the two sensors 9 together, four signals are generated which are averaged so that the average value of all four signals triggers the displacement of the sheet over the predetermined distance 20. All of the succeeding sheets 13, following the leading edge alignment thereof, are likewise initially guided laterally past the sensors 9 and then returned to the in-register position corresponding to that of the sheet 14 in FIG. 4.

The measuring line 12 and, thus, the position of the sensors 9 are variable by means of a suitable non-illustrated device. Due to this adjustment capability, it is possible, for example, to set the scanning device to different sheet sizes. Register errors may also be corrected by means of this device.

Figure 5:
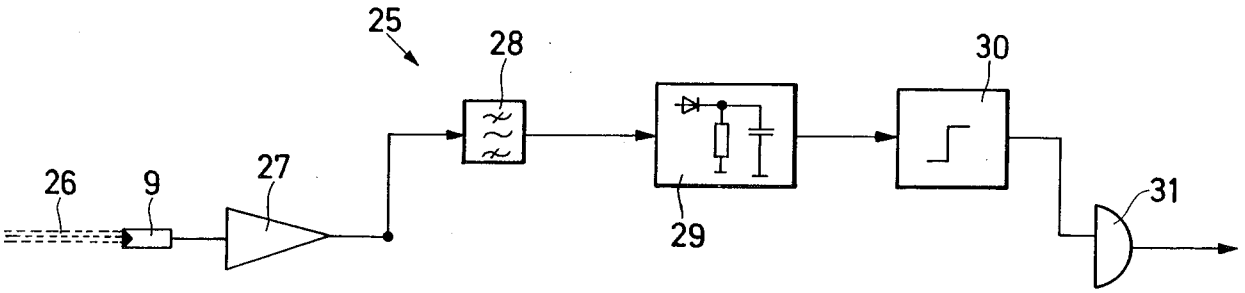
FIG. 5 is a block diagram of the electronic scanning device.

FIG. 5 is a block diagram of the scanning device 25 for monitoring the sheets. This scanning device 25 is formed of at least one sensor 9 and a triggered, digital control electronic system which is connected to this sensor 9. When a light beam 26, for example, is interrupted by an arriving sheet i.e. when there is a sheet between the sensor 9 and the measuring slit 8, the signal is processed i.e. generated and transmitted.

Figure 6:
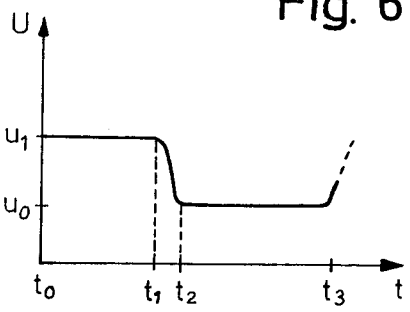
FIG. 6 is a plot diagram showing a voltage-time curve of the generated signal.

The signal curve is shown in the plot diagram of FIG. 6 wherein the time t is plotted on the abscissa and the voltage U is plotted on the ordinate. The voltage curve follows a course wherein, at the starting time $t_0$, the measuring line 12 is clear and the voltage is $U_1$. It maintains its value until the time $t_1$ at which instant the measuring line 12 becomes covered by the sheet. Within the brief span of time from $t_1$ to $t_2$, the voltage drops to the value $U_o$. The lower voltage level $U_o$ is maintained until the sheet again clears the measuring line 12 due to the aligning displacement of the sheet edge. This occurs at the time $t_3$. The voltage then increases again to the value $U_1$. These periods are repeated for each passage of a sheet edge.

This voltage edge or slope in the time period from $t_1$ to $t_2$ is used by the digital, triggered control electronics system. The voltage drop from $U_1$ to $U_o$ is generated in the sensor by the sheet edge passing the beam 26. The signals generated thereby are then further processed, the signals being amplified by an operational amplifier 27 which also serves as a comparator. The amplified signal is transmitted via a band-pass filter 28 to a rectifier 29. The rectified useful signal is triggered by means of the trigger 30 and is fed via a gate 31 to the suction box 5 for the latter to effect the displacement of the sheet.

The foregoing is a description corresponding in substance to German Application No. P 33 01 722.0, dated Jan. 20, 1983, the International priority of which is being claimed for the instant application, and which is hereby made part of this application. Any material discrepancies between the foregoing specification and the aforementioned corresponding German application are to be resolved in favor of the latter.

I claim:

1. Method of feeding sheets in register in a sheet-processing machine wherein the sheets are displaced with the aid of an optoelectronic scanning device and an alignment device in a given direction in the machine perpendicularly to an edge of each sheet which is to be aligned, which comprises so displacing the sheets that the edge of the sheet passes and covers a measuring zone of a scanning device, gripping the sheet with the alignment device and applying an alignment displacement thereto so that the sheet covering the measuring zone clears the measuring zone of the scanning device again; generating a signal in response to clearance of the scanning device by the sheet edge and, in response to the generated signal, further displacing the sheet a given ever-constant distance from the measuring zone of the scanning device to a position wherein the respective sheets are in register.

2. Method according to claim 1 wherein the sheets are conveyed to a printing unit in a continuous stream feeding operation wherein respective leading edge portions of succeeding sheets overlap respective trailing edge portions of preceding sheets, and which includes the displacing the sheets transversely to the conveying direction and passing a side edge of the respective sheets of the stream of sheets past the measuring zone of the scanning device and, after the passage of the side edge has been detected by the scanning device, moving the sheets transversely to the sheet-conveying direction a given constant distance for all of the sheets into the in-register position.

3. Method according to claim 1 wherein the aligning device is disposed for aligning a lateral edge of the respective sheets and which includes covering the scanning device with a leading edge portion of the respective sheets and simultaneously checking respective leading edges of the sheets by means of the scanning device.

4. Method according to claim 1 wherein the conveyed sheets, respectively, are displaced first to the scanning device and then away from the scanning device so that the respective edge thereof passes the measuring zone of the scanning device twice.

5. Device for feeding sheets in register in a sheet-processing machine wherein the sheets are conveyed perpendicularly to an edge of the sheet which is to be aligned, comprising an optoelectronic scanning device including at least one sensor for sensing passing of a sheet edge by said sensor and for generating signals in response to said passing, a triggered, digital electronic control system connected to said sensor for processing and transmitting the generated signals, and an aligning device coupled with said control system for executing displacement of the respective sheets in accordance with said signals and for further displacing the respective sheets a constant distance from the scanning device into a prescribed in-register position.

6. Device according to claim 5 including a plurality of scanning devices, and means for checking at least one of the leading edge and a lateral edge of the respective sheet.

7. Method of feeding sheets in register in a sheet-processing machine wherein the sheets are displaced with the aid of an optoelectronic scanning device and an alignment device in a given direction in the machine perpendicularly to an edge of each sheet which is to be aligned, which comprises so displacing the sheets that the edge of the sheet passes and covers a measuring zone of a scanning device, gripping the sheet with the alignment device and applying an alignment displacement thereto so that the sheet covering the measuring zone clears the measuring zone of the scanning device again; generating a signal in response to clearance of the scanning device by the sheet edge and, in response to the generated signal, further displacing the sheet a given variable distance from the measuring zone of the scanning device to a position wherein the respective sheets are in register.

* * * * *